US005328016A

United States Patent [19]

Leifeld et al.

[11] Patent Number: 5,328,016

[45] Date of Patent: Jul. 12, 1994

[54] METHOD AND APPARATUS FOR PLACING FIBER BALES IN READINESS FOR REMOVING FIBER TUFTS THEREFROM

[75] Inventors: Ferdinand Leifeld, Kempen; Josef Temburg, Jüchen; Ulrich Vollrath, Neuss, both of Fed. Rep. of Germany

[73] Assignee: Trützschler GmbH & Co. KG, Mönchengladbach, Fed. Rep. of Germany

[21] Appl. No.: 120,848

[22] Filed: Sep. 15, 1993

Related U.S. Application Data

[63] Continuation of Ser. No. 936,702, Aug. 28, 1992, abandoned.

[30] Foreign Application Priority Data

Aug. 28, 1991 [DE] Fed. Rep. of Germany ..... 4128471
May 6, 1992 [DE] Fed. Rep. of Germany ..... 4214934

[51] Int. Cl.[5] ..... B65G 47/00

[52] U.S. Cl. ..... 198/345.1; 198/434; 414/798.2; 414/799; 414/412; 19/80 R

[58] Field of Search ..... 198/345.1, 434, 418.9, 198/461; 414/111, 132, 411, 412, 798.2, 799; 19/80 R

[56] References Cited

U.S. PATENT DOCUMENTS

| | | | |
|---|---|---|---|
| 3,236,162 | 2/1966 | Reist | 414/798.2 |
| 3,458,904 | 8/1969 | Kotter et al. | 19/80 R |
| 3,884,345 | 5/1975 | Tokuno | 414/798.2 |
| 5,090,864 | 2/1992 | Leifeld | 414/412 |
| 5,179,763 | 1/1993 | Zander et al. | 19/80 R |

*Primary Examiner*—Joseph E. Valenza
*Attorney, Agent, or Firm*—Spencer, Frank & Schneider

[57] ABSTRACT

An apparatus for placing fiber bales into readiness for removing fiber tufts therefrom by a travelling bale opener has a fiber bale depositing device for positioning an initial fiber bale at an inclined orientation to the vertical and for positioning, adjacent the initial fiber bale, an additional fiber bale at an angle of inclination greater than the angle of inclination of the initial bale as viewed codirectionally with the angle of the initial bale; a bale-supporting device for engaging and stabilizing the initial fiber bale; a displacing device for moving the bale-supporting device into and out of engagement with the initial fiber bale; and a control device for automatically operating the fiber bale depositing device and the displacing device for automatically and sequentially depositing the initial fiber bale, moving the bale-supporting device into engagement with the initial fiber bale, depositing the additional fiber bale into a counter-supporting engagement with the initial fiber bale and moving the bale-supporting device out of engagement with the initial fiber bale.

8 Claims, 11 Drawing Sheets

METHOD AND APPARATUS FOR PLACING FIBER BALES IN READINESS FOR REMOVING FIBER TUFTS THEREFROM

This application is a continuation of application Ser. No. 07/936,702, filed Aug. 28, 1992, now abandoned.

CROSS REFERENCE TO RELATED APPLICATION

This application claims the priority of German Application Nos. P 41 28 471.2 filed August 28, 1991 and P 42 14 934.7 filed May 6, 1992, which are incorporated herein by reference. Further, this application contains subject matter related to U.S. application Ser. No. 07/936,645 filed Aug. 28th, 1992.

BACKGROUND OF THE INVENTION

This invention relates to a method and an apparatus for placing fiber bales in readiness in a row along a travelling fiber bale opener wherein the leading (that is, first-deposited) bale or bales are positioned with a slight inclination in one direction and the other fiber bales are positioned upright or with an inclination toward the opposite direction.

The fiber bales, after wrappers and bale ties have been removed therefrom, are transported individually or in a plurality from the bale storage or a standby station in the spinning preparation plant to the bale opener where they are positioned in a row for removal of fiber tufts by the bale opener. Frequently, for transporting the fiber bales a fork lift with gripper is used whose parallel tines (claws) are movable horizontally relative to one another. The gripper clamps together, for example, three bales laterally and is lifted, together with the fiber bales. Thereafter, the fork lift travels in the plant to the predetermined location where the fiber bale row is to be positioned, then the gripper is lowered and thus the fiber bales are deposited on the floor. Thereafter, the gripper is released and the fork lift moves away. The bale row, because of the horizontal force component of the operational force exerted during bale opening, has to be standing in a stable manner. For this purpose, the three initial bales of a bale series are situated with a slight inclination in one direction. During this procedure, operating personnel has to support the inclined initial bales—for preventing them from tipping over—until further fiber bales are set up in their immediate vicinity. For this purpose, such subsequent fiber bales are brought to the location where the fiber bales are set up and are positioned either upright or with a slight inclination in the other direction, against the initial fiber bales so that an additional support for the initial fiber bales can be discontinued. Such a procedure requires supplemental labor and involves significant safety risks. It is a further disadvantage of this method that an automatic positioning of the entire fiber bale series, particularly to prevent the initial bales from tipping over, is not possible without assistance from personnel. An automatic and stable positioning of a fiber bale series has therefore not been possible with known methods.

SUMMARY OF THE INVENTION

It is an object of the invention to provide an improved method and apparatus of the above-outlined type from which the discussed disadvantages are eliminated and which, in particular, ensures the support of the initial fiber bales and an automatic setup of the entire fiber bale series in a simple and secure manner.

This object and others to become apparent as the specification progresses, are accomplished by the invention, according to which, briefly stated, the apparatus for placing fiber bales into readiness for removing fiber tufts therefrom by a travelling bale opener has a fiber bale depositing device for positioning an initial fiber bale at an inclined orientation to the vertical and for positioning, adjacent the initial fiber bale, an additional fiber bale at an angle of inclination greater than the angle of inclination of the initial bale as viewed codirectionally with the angle of the initial bale; a bale-supporting device for engaging and stabilizing the initial fiber bale; a displacing device for moving the bale-supporting device into and out of engagement with the initial fiber bale; and a control device for automatically operating the fiber bale depositing device and the displacing device for automatically and sequentially depositing the initial fiber bale, moving the bale-supporting device into engagement with the initial fiber bale, depositing the additional fiber bale into a countersupporting engagement with the initial fiber bale and moving the bale-supporting device out of engagement with the initial fiber bale.

By virtue of the measures according to the invention, the initial fiber bales are supported in a simple and secure manner. Advantageously, apart from providing a support of the initial bales without the need of personnel, an automatic placement of the entire bale series is feasible. In case some of the fiber bales, for example, four or five bales, are positioned with an inclination, opposite to that of the initial fiber bales, no further holding or supporting device is needed because the bales are self-supporting.

The method according to the invention has the following additional advantageous features:

The bale supporting device travels along the initial bale or bales. In this manner, the support element is moved from bale to bale or moved away from the bales altogether.

The bale supporting device is immobilized at predetermined positions relative to the initial bales. In this procedure, the motion of the bale supporting device is stopped when the predetermined initial bale is reached. The motion of the bale supporting device may be effected either by travel or by swinging displacements of bale supporting members secured to a travelling or fixed stand.

The bale supporting function to stabilize the initial fiber bales is effected by the bale opener itself which has a travelling tower supporting a detaching device laterally projecting therefrom.

The detaching device, during operation, extends over the fiber bales transversely to the working direction (that is, transversely to the direction of bale opener travel) and exerts a stabilizing pressure on the fiber bales from above.

The initial fiber bale or fiber bales are set up and stabilized by the bale opener or the holding element and then the additional fiber bales are positioned next to the initial bales and the bale opener or the holding element is moved away from the initial bales.

In a method where the fiber bales are positioned on a conveyor belt or the like, the initial fiber bales, the conveyor belt and the bale opener which supports the initial fiber bales, are moved at identical speed forwardly in a horizontal direction.

The detaching device and/or the bale supporting device is, for obtaining the inclined orientation of the initial bales, brought into engagement with the initial bales and moved in a horizontal direction through a short distance.

The apparatus according to the invention has a bale supporting device which supports the initial fiber bale and which, after positioning of the bales which serve as countersupport for the initial bales (such further bales are either in a vertical orientation or are inclined towards the initial bales) is movable away from the initial bales.

The apparatus according to the invention has the following advantageous features:

The bale supporting device is movable along the initial fiber bales.

The bale supporting element is mounted on the detaching device of the bale opener.

The bale supporting element is a gripper claw, spike or the like.

The bale supporting element is movable out of or retractable into the detaching device or the bale opener tower.

The bale supporting device includes a carriage frame as well as a pivotal or shiftable or rotatable bale supporting element.

The bale supporting element has drive elements for propelling the carriage frame and for the motions of the bale supporting element relative to the frame.

A bale supporting device is mounted on an apparatus which is positioned upstream of the bale opener as viewed in the direction of material flow and which removes bale ties and wrappers from the fiber bales.

The bale supporting element is a grate bar, a plunger or the like which may press on the upper surface of the initial fiber bales.

Laterally of the bale series there is positioned a stationary stand on which an arm is mounted such that it may be pivoted about a vertical axis and further, the arm is provided with supporting elements for engaging the initial fiber bales.

An electronic control apparatus is provided which is connected to driving devices such as drive motors for effecting the travelling motion of the carriage frame of the bale supporting device and the motion of the bale supporting elements.

The driving device for the bale transporting apparatus for a bale series is connected to the control device as well.

DESCRIPTION OF THE PREFERRED EMBODIMENTS

Figure 1:
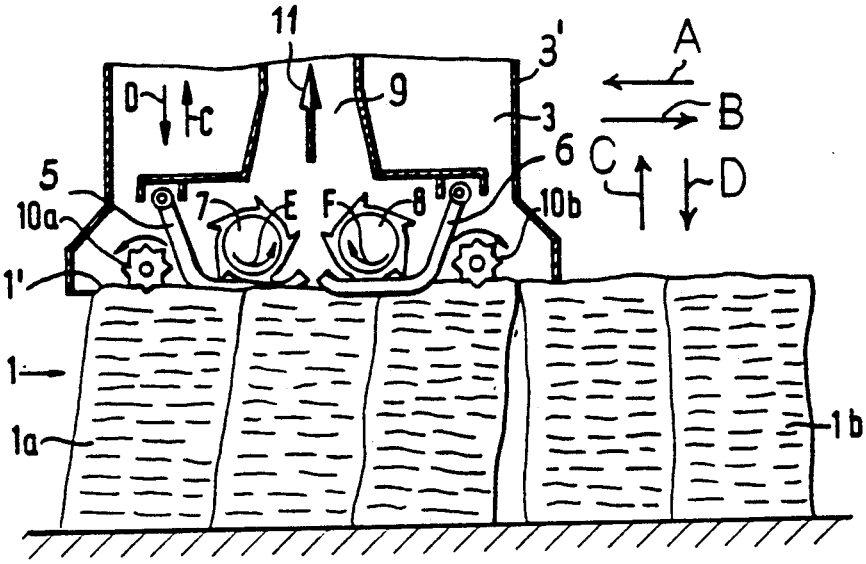
FIG. 1 is a schematic side elevational view showing a bale opener which includes a supporting mechanism in engagement with top surfaces of the fiber bales for supporting and stabilizing the same.
Figure 7:
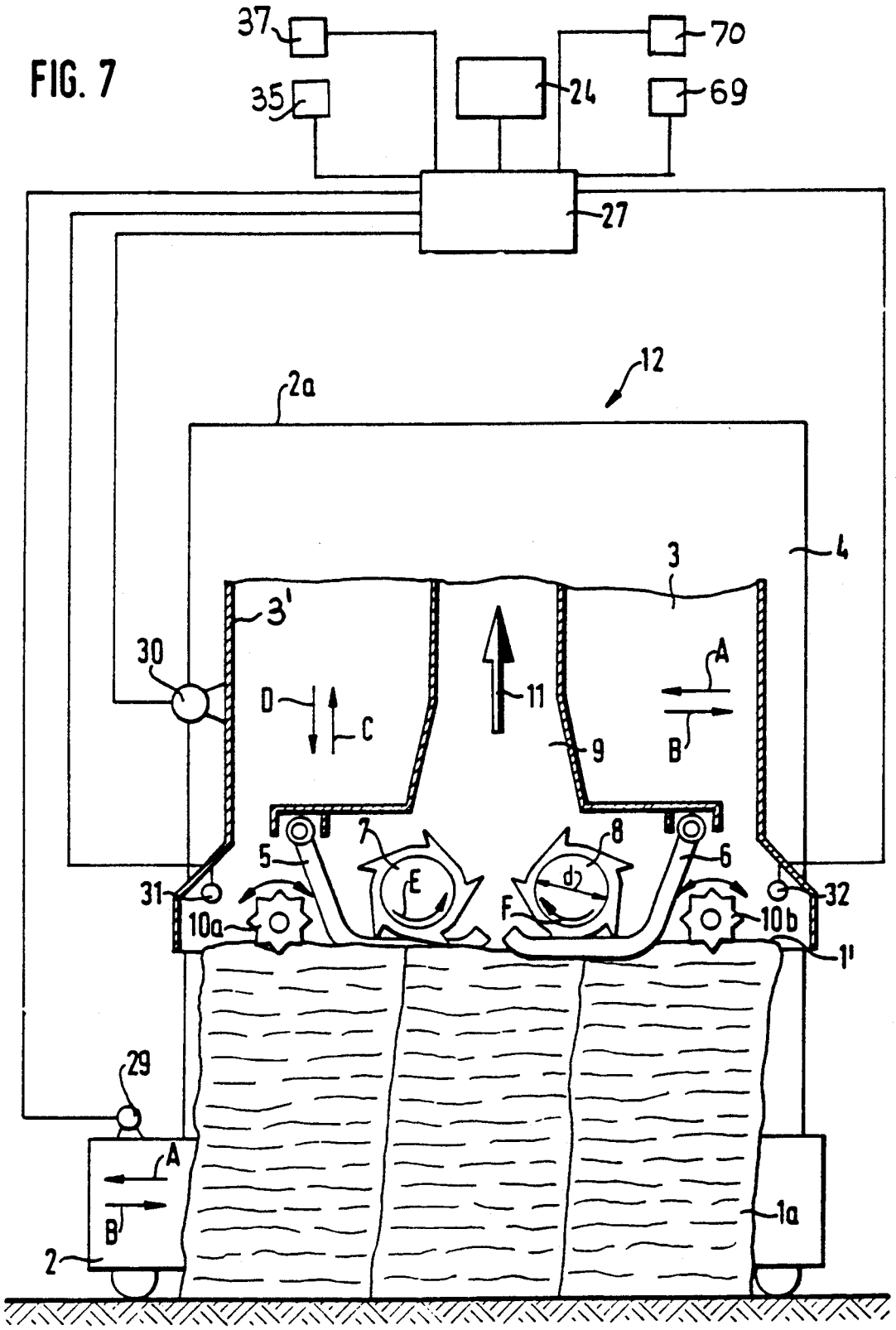
FIG. 7 is a schematic side elevational view of the fiber tuft detaching device and a block diagram illustrating an electronic control device.

In FIG. 1 which shows a preferred embodiment mounted on a bale opener 12, fiber bales 1 are arranged in a free-standing series on the floor. The bale opener 12 may be, for example, a BLENDOMAT model, manufactured by Trützschler GmbH & Co. KG, Mönchengladbach, Germany. Also referring to FIG. 7, the bale opener 12 has a travelling carriage 2 which runs on non-illustrated rails and on which there is positioned a bale opener tower 4 supporting a vertically movable fiber tuft detaching device 3 which includes a housing 3', two grate halves 5 and 6, two opening rolls 7 and 8 and a suction hood 9 for pneumatically removing the fiber tufts torn out of the fiber bales by the opening rolls 7 and 8. The detaching device 3 travels back and forth in the direction of arrows A and B. The opening rolls 7 and 8 are flanked by retaining (pressing) rolls 10*a* and 10*b* supported in the housing 3'. The direction of rotation of the opening rolls 7 and 8 is oriented inwardly in the region of the upper face 1' of the fiber bales 1. The suction hood 9 is situated above the opening rolls 7 and 8. In operation, the detaching device 3 travels with the opening rolls 7 and 8 above the fiber bales 1 back and forth and the teeth 7*a*, 8*a* of the rapidly rotating opening rolls 7 and 8 extend through the gaps between the grate bars 5 and 6. The fiber tufts torn from the upper face of the fiber bales 1 are thrown inwardly by the opening rolls 7 and 8 and they are immediately picked up by the air stream 11 and are removed through the suction hood 9. After each pass of the bale opener 12, the detaching device 3 is lowered in the direction of the arrow D. The detaching device 3 may also be moved vertically upwardly as indicated by the arrow C.

In FIG. 1, a bale series 1 formed of a plurality of fiber bales is shown in which the three first-deposited, initial fiber bales 1*a* have a slight inclination in the direction B and the subsequently positioned fiber bales 1*b* are upright (or they may have a slight inclination in the opposite direction A). All the fiber bales are positioned on the floor in a free-standing manner. In operation, the first (left-most) initial bale 1*a* is transported and deposited with an inclination in the direction B. Thereafter, the detaching device 3 of the bale opener 12 is lowered in the direction D from above into engagement with the upper face 1' of the fiber bale 1 so that the lower region of the detaching device 3 (for example, the grate halves 5, 6, the opening rolls 7 and 8 and the depressing rolls 10*a*, 10*b*) are in part or in their entirety in engagement with the upper face 1' and are pressed thereagainst. By means of the pressing force the uppermost fiber bale layers which, after removal of the bale ties have been expanded, are again compressed (densified). Thereafter, a further initial bale 1*a* is positioned next to the first initial bale 1*a*, again with an inclination in the direction B. The detaching device 3 is lifted in the direction of the arrow C and moved by propelling the carriage 2 with the tower 4, in the direction B and thereafter again lowered in the direction of the arrow D onto the upper surface 1' of the second initial fiber bale 1*a*. In this manner the initial fiber bales 1*a* are held and supported by the detaching device 3, that is, they are stabilized and thus prevented from tipping over so that the bale unloading device may again move away. After, for example, three initial bales 1*a* with an inclination in the direction B have been deposited, additional fiber bales 1*b* with an inclination in the opposite direction A (or an upright orientation) are positioned such that the first additional bale 1*b* is in engagement with the last (rightmost) initial bale 1*a*, whereas the additional bales 1*b* are in engagement with one another. In this manner, the initial bales 1*a* are supported and stabilized by the counterpressure exerted by the additional bales 1*b* and thus automatically and stepwise, a stable, free-standing fiber bale series is assembled.

Figure 2:
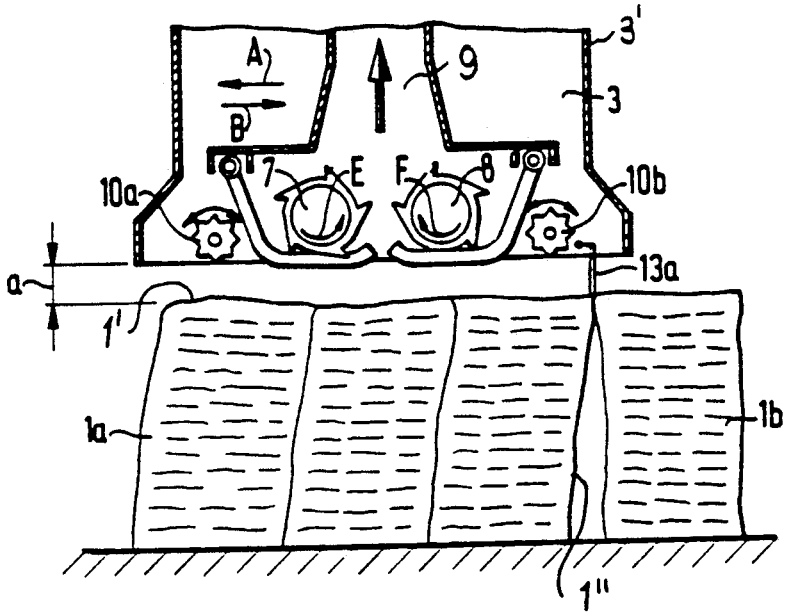
FIG. 2 is a schematic side elevational view of a fiber tuft detaching device shown in a raised position above the fiber bales and including a holding element attached to the detaching device.

In the embodiment according to FIG. 2, to the bottom region of the housing 3' of the detaching device 3 a screen 13*a* is secured which, by means of a non-illustrated displacing device may be moved downwardly to project beyond the outline of the housing 3' or may be upwardly retracted thereinto. While the detaching device 3 is at a distance a above the upper bale surfaces 1' the screen 13*a* is in a supporting engagement with the upper region of the end face 1'' of the third initial bale 1*a*.

Figure 3:
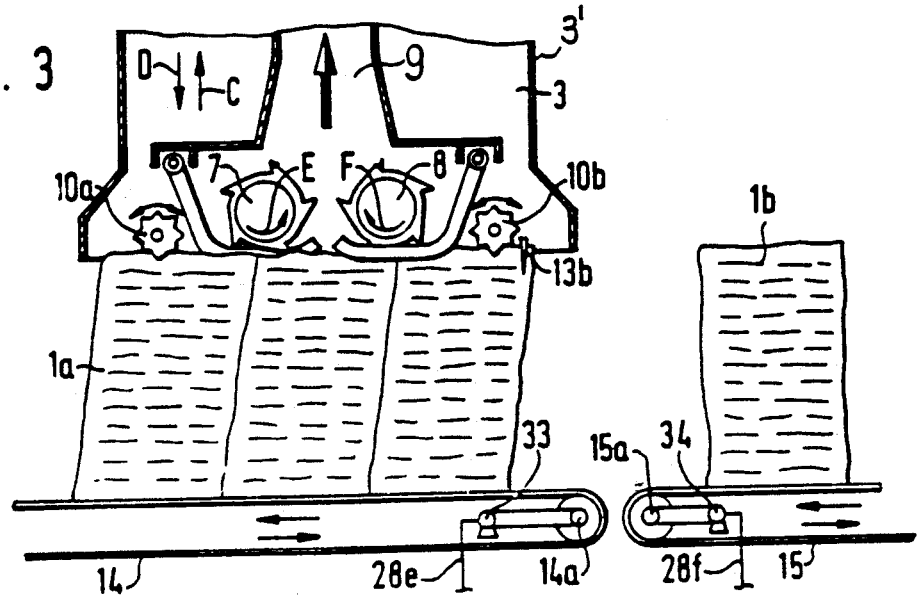
FIG. 3 is a schematic side elevational view of a detaching device similar to FIGS. 1 or 2, further showing a conveyor belt on which the fiber bales undergoing opening operation are supported as well as an additional conveyor belt for the supply of further fiber bales.

In FIG. 3, the initial bales 1*a* are positioned on a conveyor belt 14 which is in a longitudinal alignment with a conveyor belt 15 by means of which further fiber bales 1*b* are supplied. The conveyor belt 14 with the initial bales 1*a* and the detaching device 3 with the bale opener tower 4 and the carriage 2 may be simultaneously moved with identical speeds in the direction A, while the detaching device 3 and the spike-like holding element 13*b* which is in engagement with the upper bale surface 1' may support and stabilize the initial fiber bales 1*a*.

Figure 4A:
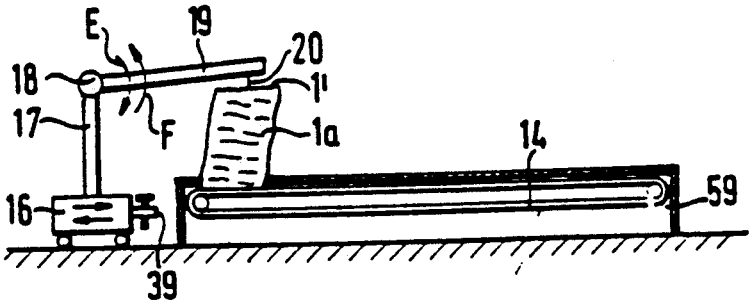
FIG. 4*a* is a schematic side elevational view of a travelling, pivotal bale supporting device having a spike-like bale supporting element.
Figure 4B:
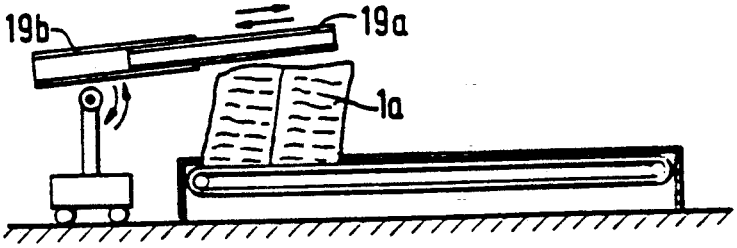
FIG. 4*b* is a schematic side elevational view of a travelling bale supporting device having a telescoping bale supporting element.
Figure 4C:
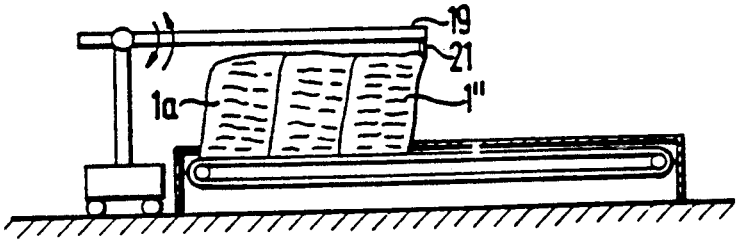
FIG. 4*c* is a schematic side elevational view of a travelling bale supporting device having a screen-like bale supporting element.

In FIG. 4*a* a carriage 16 is shown which can travel in the directions A and B and on which a post 17 is mounted, carrying, at its top, a cantilever arm 19 secured to the post 17 by a pivotal support 18. The outer free end of the cantilever arm 19 carries at least one downwardly oriented bale-supporting element 20 which is constituted by a spike adapted to penetrate into the upper surface 1' of the fiber bale. The initial bale 1*a* is supported on the conveyor belt 14. The carriage 16 is associated with a carriage-immobilizing device 39. In the embodiment shown in FIG. 4*b* the post 17 supports a cantilever arm 19*a* telescopically received in a tube 19*b* which, in turn, is pivotally mounted on the top of the post 17. In the embodiment shown in FIG. 4*c* whose structure is similar to that illustrated in FIG. 4*a*, the free end of the cantilever arm 19 supports a screen or shield 21 which engages the end face 1'' of the initial fiber bale 1*a*.

Figure 4D:
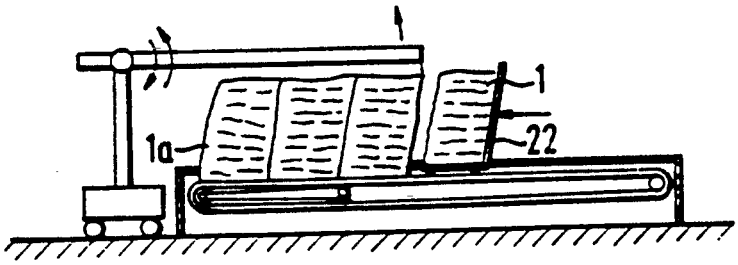
FIG. 4*d* is a schematic elevational view of a bale supporting device according to FIG. 4*a* associated with a bale transporting carriage.
Figure 4E:
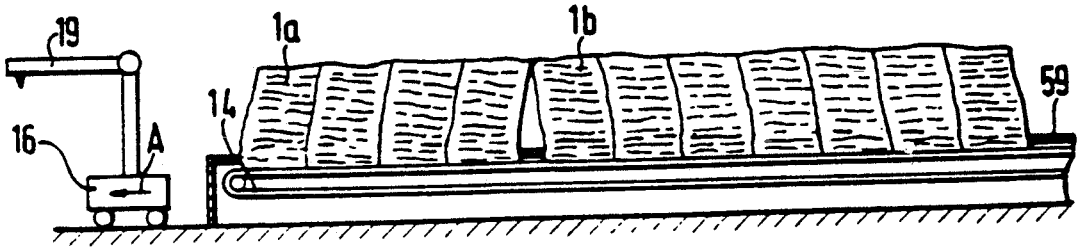
FIG. 4*e* is a schematic side elevational view of a bale supporting device according to FIG. 4*a* showing the latter out of engagement with the fiber bales.

FIG. 4*d* shows a loading device constituted by a bale transporting carriage 22 which moves a fiber bale 1 to the last (extreme right) initial bale 1*a*. As shown in FIG. 4*e*, the post 17 has been rotated about a vertical axis in such a manner that the cantilever arm 19 has been pivoted away from the fiber bales 1*a*, 1*b* in the direction H (as shown in FIG. 5*a*) and the carriage 16 has been moved from the finished fiber bale series 1*a*, 1*b* in the direction of the arrow A.

Figure 5A:
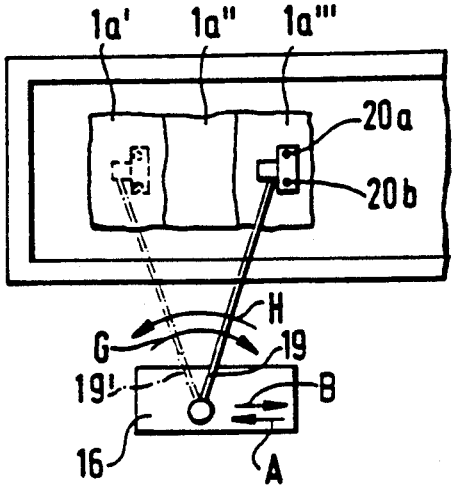
FIG. 5*a* is a schematic top plan view of the construction shown in FIG. 4*a*.
Figure 5B:
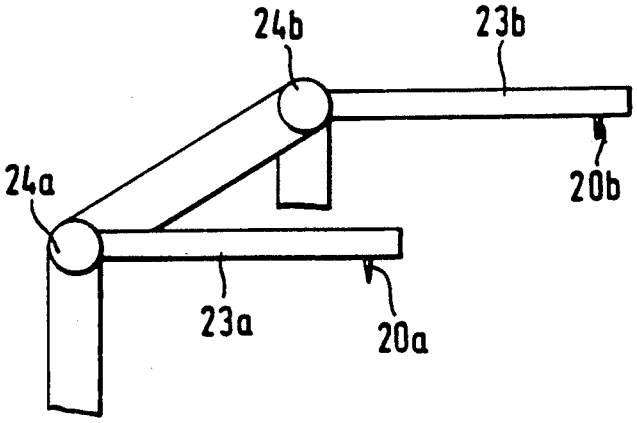
FIG. 5*b* is a partial perspective view of the construction shown in FIG. 4*a*.

As shown in FIG. 5*a*, the cantilever arm 19 is sequentially pivoted in the direction G to dwell above the momentarily last (extreme right) respective fiber bale 1*a*', 1*a*'' and 1*a*''' to firmly hold such bale by the spikes 20*a* and 20*b*. According to FIG. 5*b*, the spikes 20*a* and 20*b* are secured unilaterally on the respective rotatable levers 23*a* and 23*b* by means of a pivotal bearing 24*a*, 24*b* mounted on the cantilever arm 19.

Figure 6A:
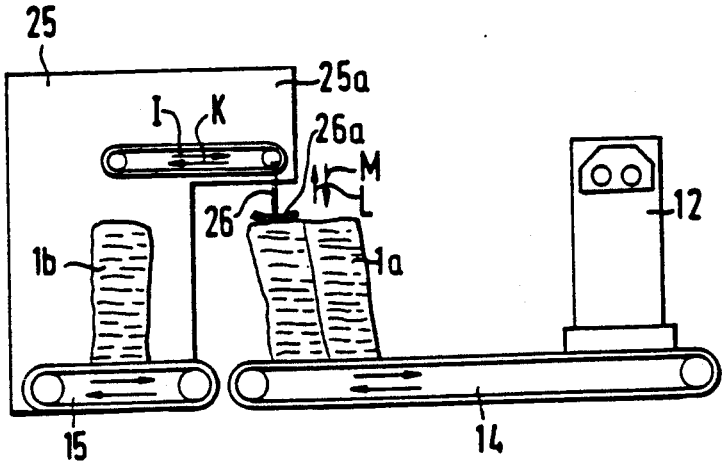
FIG. 6*a* is a schematic side elevational view of a bale supporting device having a horizontally and vertically movable supporting element in contact with a fiber bale.
Figure 6B:
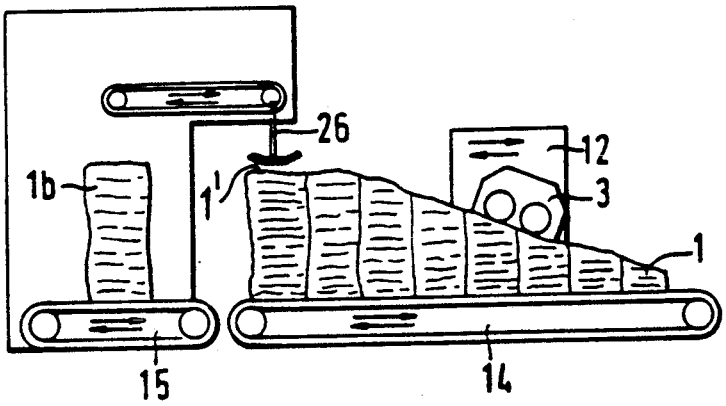
FIG. 6*b* is a view similar to FIG. 6*a*, illustrating the bale supporting device out of contact with the fiber bales.

Turning to FIG. 6*a*, upstream of the conveyor belt 14 (as viewed in the direction of material flow) there is situated a stationary bale supply station 25 such as a bale preparing station having a conveyor belt 15. In a housing 25*a* which projects over the conveyor belt 14, there is provided a bale holding device constituted by a plunger 26 which is shiftable horizontally in the direction of the arrows I, K. The plunger 26 is also shiftable vertically in the direction of arrows L, M and presses down with its other end (grate 26*a*) on the upper face 1' of the initial fiber bale 1*a*. The plunger 26 may be slowly displaced with the same speed as the conveyor belt 14 in the direction I. As shown in FIG. 6*b*, the plunger 26 is, with the grate 26*a*, lifted off the upper face 1' of the fiber bale in the direction of the arrow L. The bale opener 12 whose detaching device 3 has been rotated about a horizontal axis, works along an inclined upper surface of the bale series 1 and removes fiber tufts therefrom.

Figure 8:
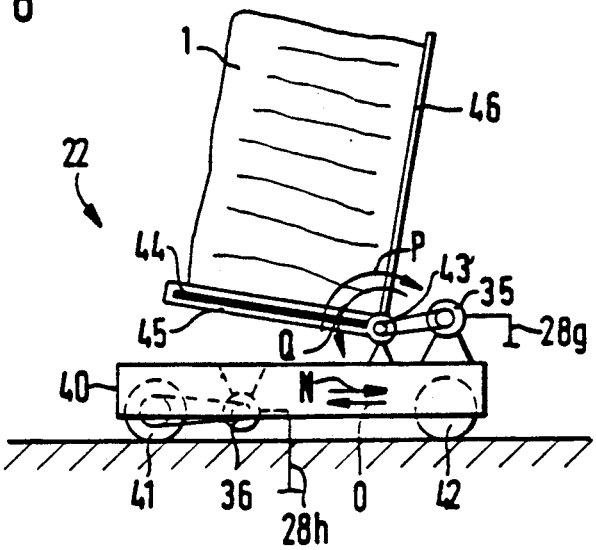
FIG. 8 is a schematic side elevational view of a bale transporting carriage.

Turning to FIG. 8, the carriage 22 has a chassis 40 provided with four runner wheels 41, 42 (only two are visible in FIG. 8) and is propelled by a drive motor 36 driving wheels 41 to travel horizontally in the direction of arrows N and 0. On the chassis 40 there is mounted a pivot mechanism 43 to which there is attached one end of the support bottom 44 (which may a sheet metal member or a grate) together with a carrier frame 45, and the upwardly extending rear wall 46 for supporting the fiber bale 1. The components 44, 45 and 46 are thus pivotal about the pivot arrangement 43 individually or as a unit, indicated by the arrows P and Q.

Figure 9A:
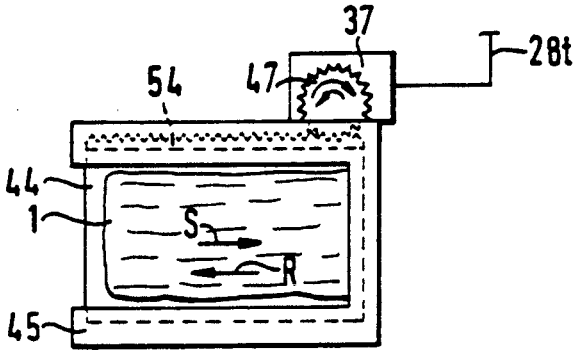
FIGS. 9*a* and 9*b* are schematic top plan views of modified parts of the transporting carriage shown in FIG. 8.

In FIG. 9*a* the carrier frame 45 is of forked (generally U-shaped) configuration and is thus frontally open. The support bottom 44 is shiftable in the direction of the arrows R and S by a shifting device formed of a toothed rack 38, a meshing pinion 47 and a motor 37 driving the pinion 47.

Figure 10A:
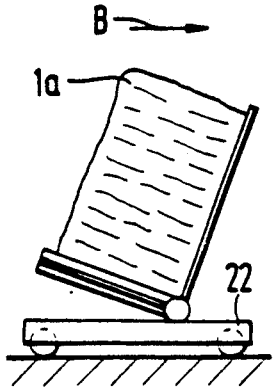
FIGS. 10*a*, 10*b*, 10*c* and 10*d* are sequential schematic side elevational views showing the operation of the transporting carriage illustrated in FIG. 8 when the fiber bale is deposited in the direction B.
Figure 10B:
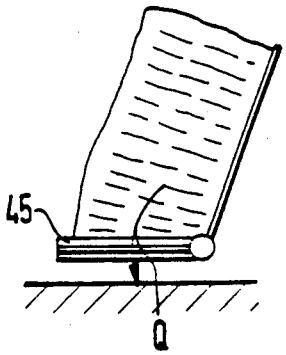
Figure 10C:
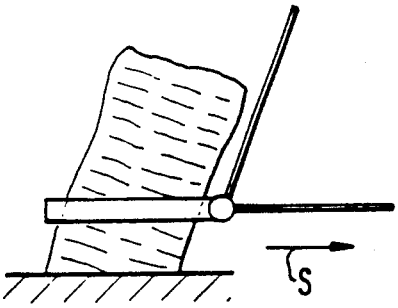
Figure 11C:
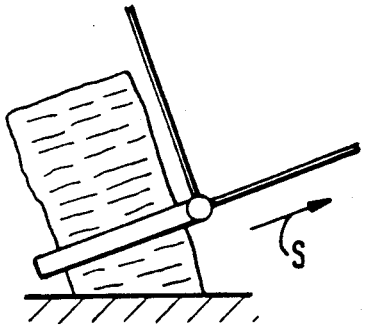
Figure 10D:
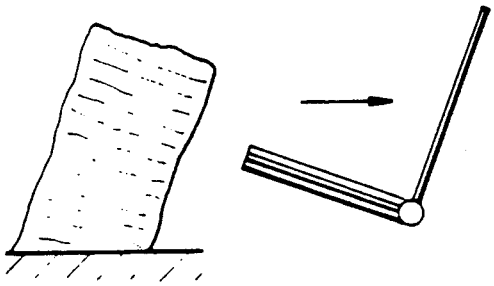
Figure 11D:
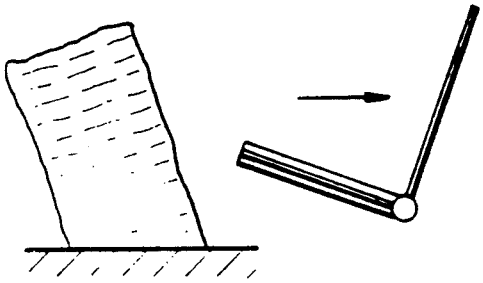

FIGS. 10*a*–10*d* schematically show in sequence the positioning of a fiber bale 1*a* which is transported to the location of deposition while inclined in the direction B as shown in FIG. 10*a*. Thereafter, according to FIG. 10*b*, the carrier frame 45 is pivoted downwardly in the direction Q relative to the rear wall 46 and, as shown in FIG. 10*c*, the support bottom 44 is withdrawn in its own plane in the direction S so that the fiber bale 1*a* may be deposited on the floor of the spinning preparation plant or on the previously described conveyor belt 14 or 14'. Thereafter, the transporting carriage 22 is moved away.

Figure 11A:
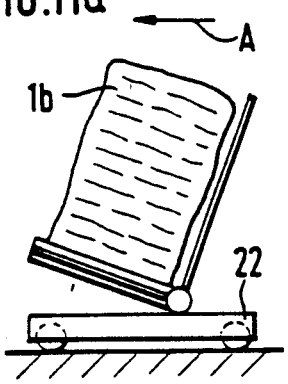
FIGS. 11*a*, 11*b*, 11*c* and 11*d* are sequential schematic side elevational views of the operation of the transporting carriage shown in FIG. 8, for depositing a fiber bale in the direction A.
Figure 11B:
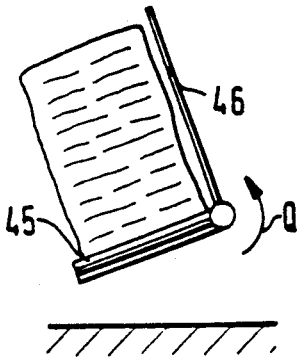

FIGS. 11*a*–11*d* schematically show the deposition of a further fiber bale 1*b* which is first transported with an inclination in the direction B as shown in FIG. 11*a*. Thereafter, according to FIG. 11*b*, the carrier frame 45 and the rear wall 46 are pivoted as a unit in the direction of arrow Q and, according to FIG. 11*c*, the support bottom 44 is pulled away in its own plane rearwardly in the direction of the arrow S. As a result, the bale 1*b* is positioned on the supporting surface (floor or conveyor belt).

Figure 12A:
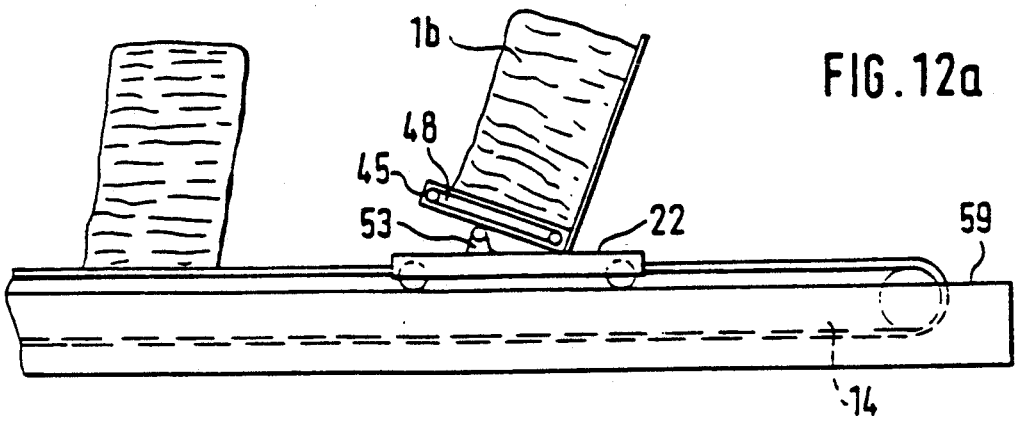
FIG. 12*a* is a schematic side elevational view illustrating a bale transporting carriage, having a stationary (non-shifting) conveyor belt, during the transportation of a fiber bale.
Figure 12B:
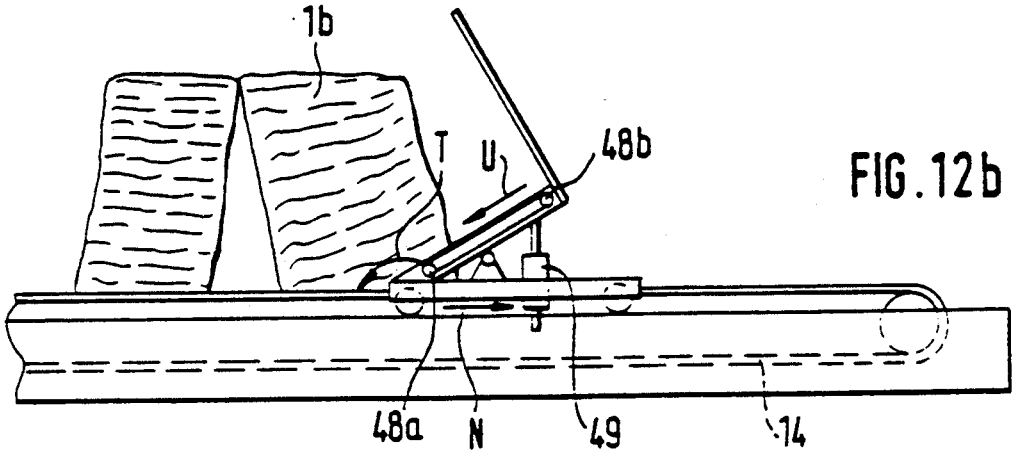
FIG. 12*b* is a schematic side elevational view of the structure shown in FIG. 12*a* depicted during unloading of a fiber bale on the conveyor belt.

In FIGS. 12*a* and 12*b* in the carrier frame 45 of the transport carriage 22 a conveyor belt 48 is arranged which is supported by end rollers 48*a*, 48*b* and on which the fiber bale 1*b* is positioned. The carrier frame 45 is mounted on the carriage 12 by a pivotal support 53, by means of which the carrier frame 45, together with the conveyor belt 48 is tiltable about a horizontal axis with the aid of a pressure cylinder 49 connected between the carriage chassis and the carrier frame 45. After swinging the frame 45 and the conveyor belt 48 together with the fiber bale 1*b* in the direction T, the conveyor belt 48 is circulated in the direction of the arrow U and, simultaneously, the carriage 22 travels, for example, on rails mounted on the frame 59 for the conveyor 14, in the direction of the arrow N. In this manner, the conveyor belt 48 supporting the fiber bale 1*b* is slowly pulled away from under the bale 1*b* and thus the latter is, without any interference with its motion, deposited on a supporting surface such as the conveyor belt 14. Thus, the conveyor belt 48 mounted on the carriage 22, simultaneously serves as a supporting bottom and as an unloading device.

Figure 13A:
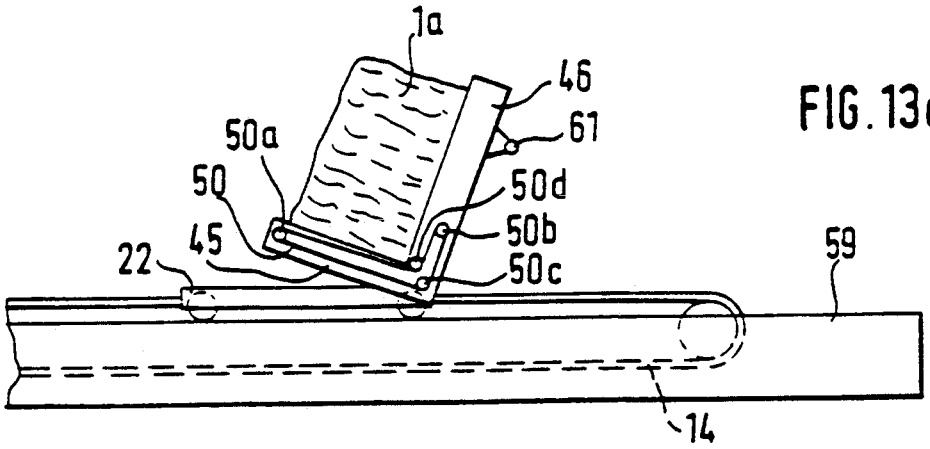
FIG. 13*a* is a schematic side elevational view of a further preferred embodiment of the invention including a shiftable conveyor belt functioning as a bale supporting and unloading device.
Figure 13B:
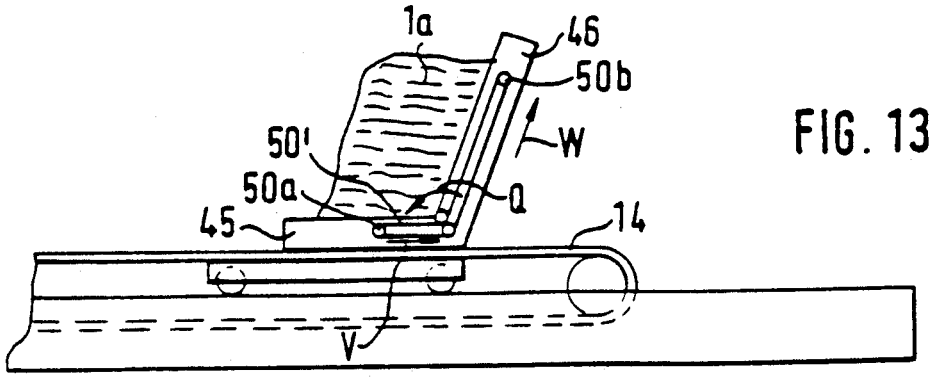
FIG. 13*b* is a schematic side elevational view of the structure shown in FIG. 13*a*, depicting another operational phase.

In FIG. 13*a*, the rear wall 46 is coupled to the carrier frame 45. Within the carrier frame 45 a conveyor belt 50 is arranged which is supported by end rollers 50*c* and 50*d* and which projects into the inner space of the rear wall 46. According to FIG. 13*b*, the carrier frame 45, together with the region of the conveyor belt 50 which is associated with the support roller 50*a*, is driven in the direction of the arrow Q into an approximately horizontal position while the rear wall 46 remains unchanged in its oblique orientation shown in FIG. 13*a*. Thereafter, the end rollers 50*a* and 50*b* are, in the respective directions V and W, slowly shifted by a motor 61. During this occurrence, the upper belt reach 50' which supports the bale 1*a*, rolls about the end roller 50*a* and thus gradually shortens in the direction V and, as a result, the bale 1*a* is deposited on the conveyor belt 14. That zone of the conveyor belt 50 which is in the region of the end roller 50*a* thus simultaneously functioning as a supporting bottom and as an unloading device.

Figure 14:
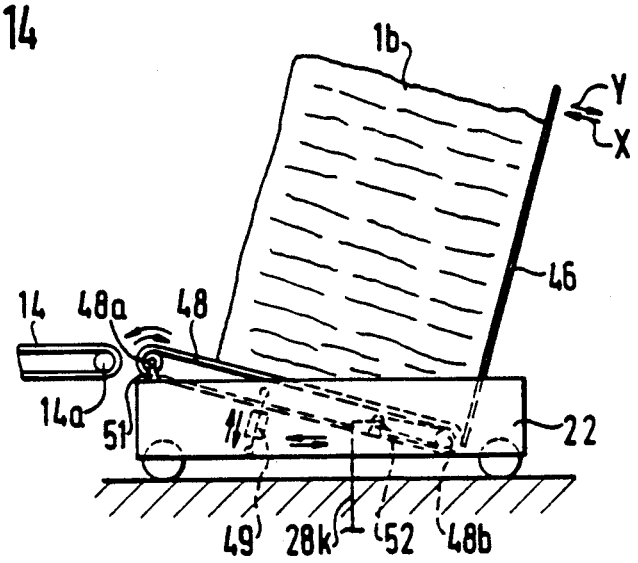
FIG. 14 is a schematic side elevational view of a bale transporting carriage having a tiltable conveyor belt bottom and a shiftable rear wall.

In FIG. 14, the carriage 22 travels together with the conveyor belt 48 mounted thereon until the end roller 14*a* of the conveyor belt 14 is reached. The rear wall 46, shiftable in the direction of the arrows X, Y and the bale 1*b* situated thereon are slightly inclined. The end roller 48*a* is associated with a pivot mechanism 51 about which the conveyor belt is swung by means of the pressure cylinder 49.

Figure 15A:
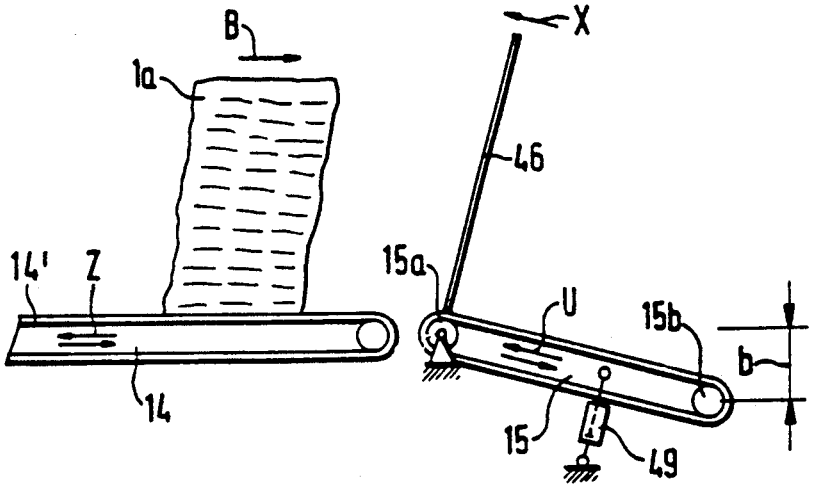
FIG. 15*a* is a schematic side elevational view of an arrangement in which a tiltable conveyor belt deposits fiber bales on another belt in an inclination into direction B.
Figure 15B:
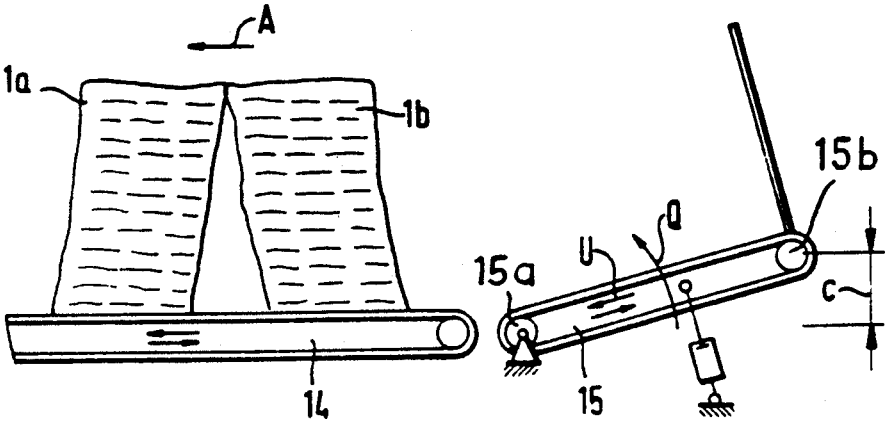
FIG. 15*b* is a schematic side elevational view of the construction shown in FIG. 15*a* showing the deposition of a fiber bale in the direction A.

As shown in FIG. 15*a*, the fiber bale 1*a* is moved by the support belt 15 as the latter runs in the direction U and by the back wall 46 as the latter is shifted in the direction X, onto the upper reach 14' of the conveyor belt 14. At the same time, the conveyor belt 14 moves in the direction Z. The end roller 15*b* is supported at a level which is by a distance b lower than the level of the end roller 15*a*. As shown in FIG. 15*b*, the conveyor belt 15 is pivoted in the direction Q and the fiber bale 1*b* is thereafter moved onto the conveyor belt 14 by virtue of the motion of the conveyor belt 15. By virtue of the pressure cylinder 49, the support roller 15*b* is lifted to a level which is by the distance c higher than the level of the support roller 15*a*. FIGS. 15*a* and 15*b* show how initial bales 1*a* and countersupporting additional bales 1*b* may be delivered to the conveyor belt 14 by means of a stationary bale supply device 15.

It is noted that the tilting possibilities of the construction shown in FIGS. 15*a* and 15*b* may be applied—by appropriate modifications—to the conveyor belt 48 of the carriage 22. It will be also understood that a driven roller track or the like may be used as the bale transporting device instead of conveyor belts 48, 15.

The invention may find application in case of a bale series 1*a*, 1*b* positioned stationarily on the floor of the plant or deposited on a conveyor belt, roller track or the like in a displaceable manner.

Figure 16:
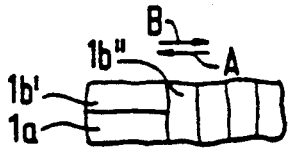
FIG. 16 is a schematic top plan view of an arrangement of fiber bales ready to undergo a fiber tuft detaching operation.

Turning to FIG. 16, the invention further may find application in cases where an initial bale 1*a* and a countersupporting bale 1*b*' are at an inclination toward one another in a direction transversely to the working direction of the bale opener and additional countersupporting bales 1*b*'' are set up in the working direction such that they lean against the fiber bales 1*a* and 1*b*'.

Figure 17A:
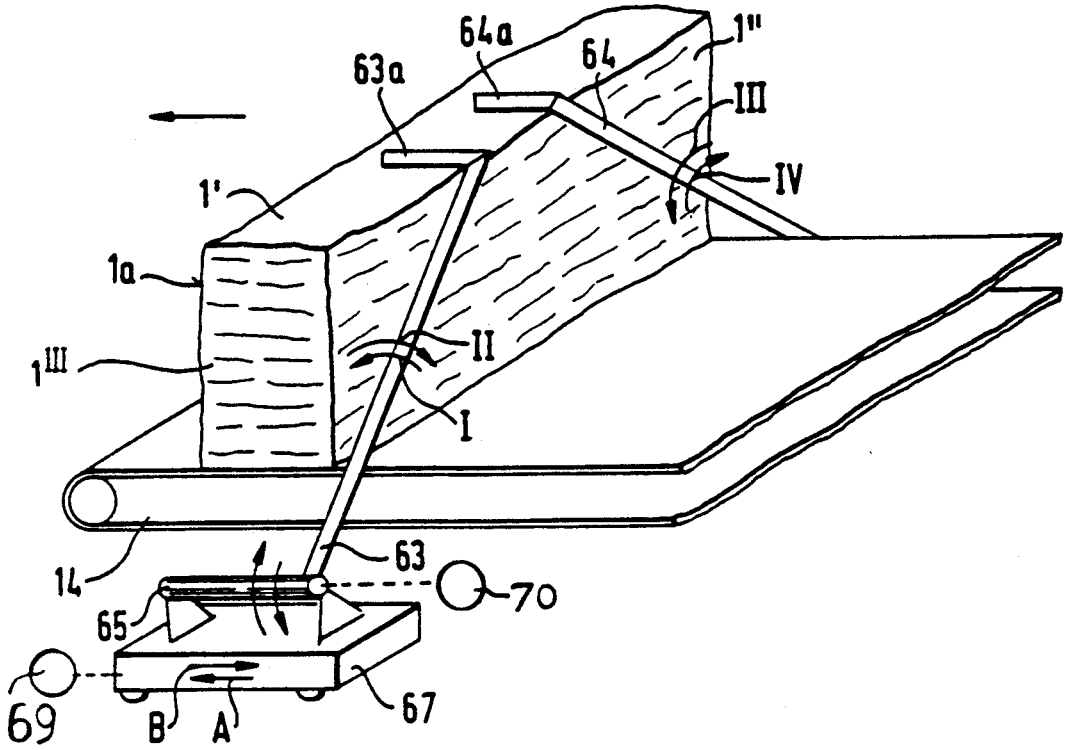
FIG. 17*a* is a schematic perspective view of a bale supporting device according to the invention.
Figure 17B:
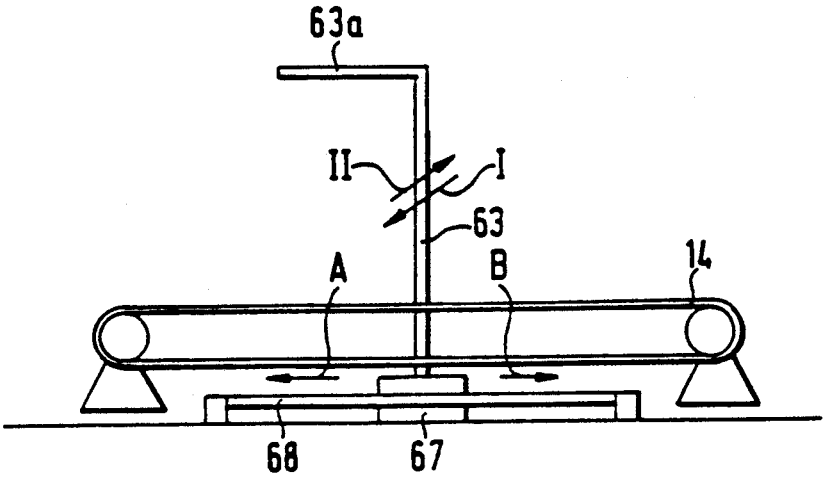
FIG. 17*b* is a schematic side elevational view of the structure of FIG. 17*a*.

Turning now to the embodiment illustrated in FIG. 17*a*, the bale supporting device is formed of two bars or tubes 63 and 64 which engage the end face 1'' of the initial fiber bale 1*a*. At their outer ends, the bars 63 and 64 have a respective angled member 63*a*, 64*a* which engage from above the top face 1' of the fiber bale 1*a*. At their opposite end the bars 63 and 64 are connected to respective pivotal supports 65 for a swinging motion about a horizontal axis oriented parallel to the working direction of the bale opener. The pivotal supports 65 are situated externally of the opposite lateral faces 1''' of the bale 1*a* and are mounted on respective carriages 67 on either side of the conveyor belt 14. The carriages 67 may travel in the directions A, B. The bars 63, 64 are pivotal in the direction of arrows I, II and III, IV in a plane perpendicular to the directions A, B. The bale-supporting device stabilizes the bales 1*a* by simultaneously engaging the top face 1' and the rear face 1'' thereof. The bale-supporting device may thus be pivoted away from the fiber bales in the direction of arrows I and IV to allow the positioning of further fiber bales 1*b*. As shown in FIG. 17*b*, the carriages 67 (only one is visible) are displaceable in the direction A, B on a track 68. The pivotal motion of the bars 63, 64 and the shifting of the carriages 67 may be effected automatically by driving elements such as centrally controlled drive motors 69, 70 as will be described later in connection with FIG. 7.

Figure 16A:
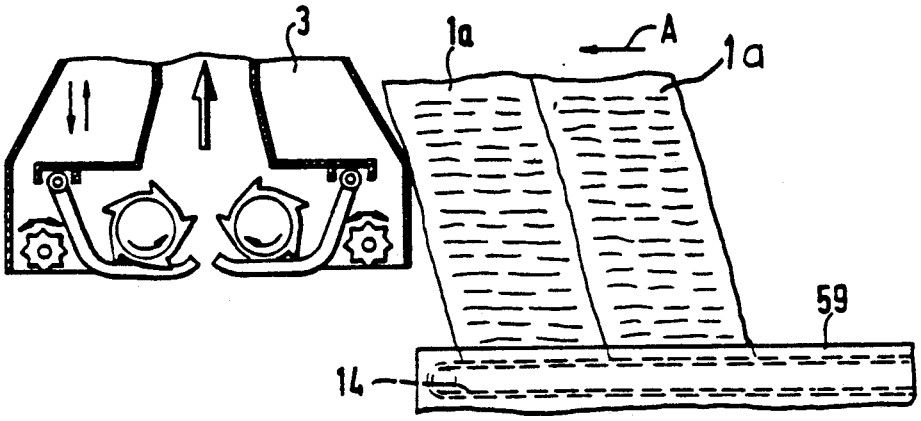
FIGS. 16*a*, 16*b* and 16*c* are sequential schematic side elevational views for supporting fiber bales by a bale opener.
Figure 16B:
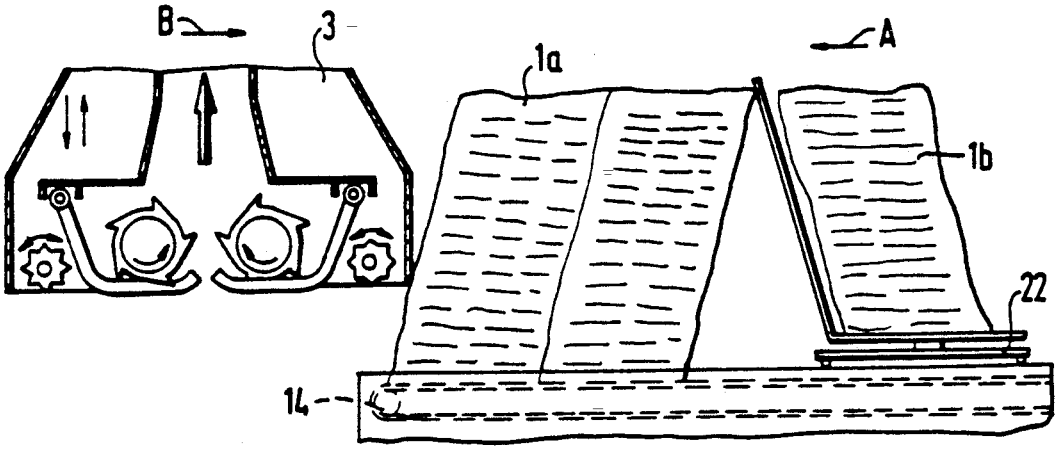
Figure 16C:
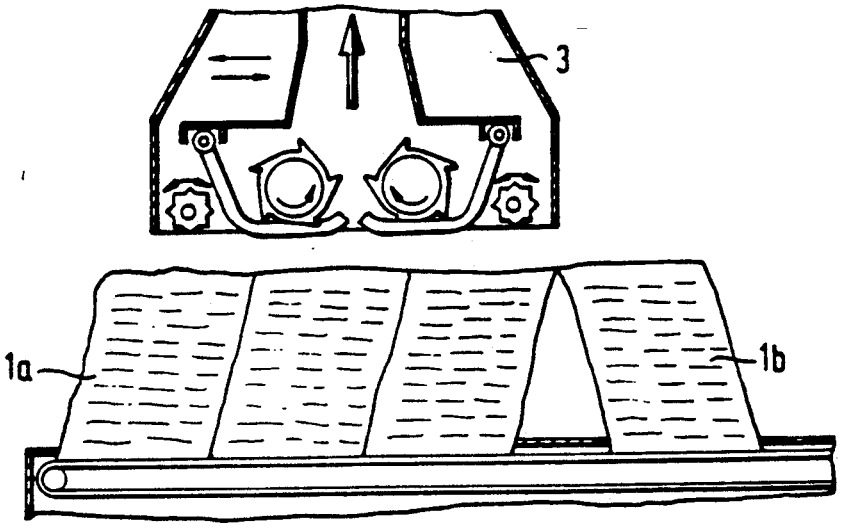

In FIG. 16*a*, for an automatic deposition of a bale series, two initial fiber bales 1*a* have been placed on the conveyor belt 14 by the bale transporting carriage 22. The fiber tuft detaching device 3 is, as viewed in the working direction A, lowered downstream of the bales 1*a* which are inclined in the working direction A. The end face of the leading bale 1*a* thus leans against the detaching device 3. Thereafter, as shown in FIG. 16*b*, by means of the carriage 22, an additional fiber bale 1*b* which leans in the direction A, is brought to the already-positioned initial bales 1*a*. Then the detaching device 3 is propelled in the direction B to travel a short distance so that the initial bales 1*a* are caused to change inclination to thus lean in the direction B and are countersupported by the carriage 22. Thereafter, the fiber bale 1*b* is deposited on the conveyor belt 14 by the carriage 22 so that the bale 1*b*, as shown in FIG. 16*c*, countersupports the fiber bale 1*a* against tipping over. During this bale assembling process, additional bales 1*b* are brought to the bale series on the conveyor belt 14 and are deposited to lean against the outermost fiber bale 1*b* at an inclination in the direction A.

The method and apparatus according to the invention permit an automatic assembly of a bale series on a conveyor belt. In operation, the fiber bales are continuously worked on by the bale opener, preferably along an inclined top face and during such operation additional fiber bales 1*b* are automatically supplied.

For performing an automatic operation of the bale opening and bale positioning machinery described above, a control device 27 is provided (FIG. 7) to which the different driving motors of all movable elements may be connected. The control device 27 is associated with a memory 24 in which the process program, including all operational sequences of bale positioning and bale opening may be inputted. Thus, to the control device 27 there are coupled movable elements and/or position sensors of three groups of machines: the bale opener, the fiber bale supplying and depositing device as well as the fiber bale supporting device.

As concerns sensor and driving elements of the bale opener 12, there is thus connected to the control device 27 the motor 29 for propelling the bale opener carriage 2, the lifting motor 30 for raising lowering the detaching device 3 relative to the tower 2*a*, a sensor 31 emitting a signal which represents the position of the bale opener along its travel as well as a sensor 32 emitting a signal which represents the height position of the detaching device 3.

Figure 9B:
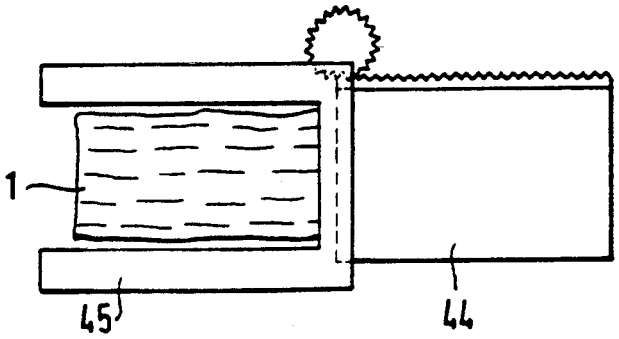

As concerns the bale transporting and depositing device, if, for example, the embodiment shown in FIGS. 8, 9*a* and 9*b* is used, to the control device 27 there are connected the drive motor 35 for varying the position of inclination of the bale-supporting components 44, 46 and the motor 37 which moves the supporting bottom 44 between normal (FIGS. 9*a*) and withdrawn (FIG. 9*b*) positions. In case conveyor belts 14 and 15 are used in accordance with FIG. 3, the belt driving motors 33 and 34 are connected to the control device 27.

With regard to the bale-supporting device, if, for example, the embodiment illustrated in FIGS. 17*a* and 17*b* is utilized, it is the drive motors 69 propelling the respective carriages 67 and the drive motors 70 pivoting the respective bars 63 and 64 that are coupled to the electronic control device 27.

The electronic control device 27 itself may be subordinated to a non-illustrated master control apparatus, for example, for controlling the overall material flow.

It will be understood that the above description of the present invention is susceptible to various modifications, changes and adaptations, and the same are intended to be comprehended within the meaning and range of equivalents of the appended claims.

What is claimed is:

1. A method of placing fiber bales into readiness for removing fiber tufts therefrom by a travelling bale opener, comprising the following consecutive steps;

(a) depositing an initial fiber bale in an operational range of the bale opener at an angle of inclination to the vertical;

(b) moving a bale-supporting device into engagement with the initial fiber bale for stabilizing the initial fiber bale in the inclined position thereof;

(c) depositing an additional fiber bale next and in engagement with the initial fiber bale such that the initial and additional fiber bales form a bale series; said additional fiber bale being deposited at an angle of inclination greater than the angle of inclination of said initial bale as viewed codirectionally with the angle of inclination of the initial bale; the angle of inclination of the additional bale being at least 90° to the horizontal; and (d) moving the bale-supporting device out of engagement with the initial fiber bale.

2. The method as defined in claim 1, wherein steps (b) and (d) comprise the step of moving the bale-supporting device parallel to the travelling path of the bale opener.

3. The method as defined in claim 1, further comprising the step of immobilizing the bale-supporting device in predetermined positions after step (b) and before step (d).

4. The method as defined in claim 1, wherein steps (a) and (c) comprise the step of depositing the fiber bales on a conveyor belt; further comprising the step of moving the bale-supporting device, while in engagement with a fiber bale, and the conveyor belt codirectionally and at identical speeds.

5. The method as defined in claim 1, wherein step (a) comprises the steps of depositing the initial fiber bale and pushing the initial fiber bale at an end face thereof into said inclined position by said bale opener.

6. The method as defined in claim 1, wherein said bale-supporting device is constituted by said bale opener having a carriage movable along the bale series, a tower mounted on the carriage and a detaching device mounted on the tower and projecting laterally therefrom; step (b) comprising the step of moving the bale opener, as the bale-supporting device, into engagement with the initial fiber bale for stabilizing the initial fiber bale in the inclined position thereof.

7. The method as defined in claim 6, wherein step (b) comprises the step of bearing down on the inclined fiber bale by said detaching device while maintaining the bale opener stationary.

8. The method as defined in claim 1, further comprising the step of automatically performing steps (a) through (d).

* * * * *